US007690485B2

(12) United States Patent
Cho et al.

(10) Patent No.: US 7,690,485 B2
(45) Date of Patent: Apr. 6, 2010

(54) POWER CORD COOLING APPARATUS FOR A VACUUM CLEANER

(75) Inventors: Young-jun Cho, Gwangju (KR); Tak-soo Kim, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 122 days.

(21) Appl. No.: 12/010,673

(22) Filed: Jan. 29, 2008

(65) Prior Publication Data

US 2009/0078812 A1 Mar. 26, 2009

(30) Foreign Application Priority Data

Sep. 20, 2007 (KR) ..... 10-2007-0096082

(51) Int. Cl.
*A47L 5/00* (2006.01)
*H02G 11/00* (2006.01)

(52) U.S. Cl. ..... 191/12.2 R; 15/323; 15/413

(58) Field of Classification Search ..... 191/12.2 R, 191/12 R, 12.4, 12.2 A; 15/323, 327, 2, 413
See application file for complete search history.

(56) References Cited

U.S. PATENT DOCUMENTS 4,701,974 A * 10/1987 Konig et al. ..... 15/323

FOREIGN PATENT DOCUMENTS

| | | | |
|---|---|---|---|
| DE | 9100815 | U1 | 4/1991 |
| DE | 102006009269 | A1 | 9/2007 |
| EP | 1188405 | A2 | 3/2002 |
| JP | 5038317 | A | 2/1993 |
| KR | 1997-0016177 | | 5/1997 |
| KR | 1020020041635 | | 6/2002 |

* cited by examiner

*Primary Examiner*—Mark T Le
(74) *Attorney, Agent, or Firm*—Blank Rome LLP

(57) ABSTRACT

A power cord cooling apparatus disposed in a cord reel chamber formed inside a main body of the vacuum cleaner to cool a power cord wound around a cord reel, wherein the power cord cooling apparatus allows outside air to enter the cord reel chamber, to contact the power cord wound around the cord reel, and to be discharged outside the cord reel chamber via a center space in the cord reel.

6 Claims, 4 Drawing Sheets

POWER CORD COOLING APPARATUS FOR A VACUUM CLEANER

CROSS-REFERENCE TO RELATED APPLICATIONS

This application claims the benefit under 35 U.S.C. §119 (a) from Korean Patent Application No. 2007-96082, filed Sep. 20, 2007, in the Korean Intellectual Property Office, the disclosure of which is incorporated herein by reference in its entirety.

FIELD OF THE INVENTION

The present invention relates to a vacuum cleaner. More particularly, the present invention relates to a power cord cooling apparatus that allows outside air to flow through a cord reel that is disposed inside the main body of a vacuum cleaner for cooling a power cord wound around the cord reel.

BACKGROUND OF THE INVENTION

Generally, a vacuum cleaner is an appliance that sucks contaminants from a surface to be cleaned, separates the contaminants using a contaminants collecting apparatus, and discharges cleaned air outside. A vacuum cleaner typically includes a power cord that will be connected with an external commercial electric power source to receive electric power and a cord reel rotatably disposed inside the main body of the vacuum cleaner to wind the power cord in coils thereon. Before cleaning using the vacuum cleaner, a user pulls out a plug, which is disposed at an end of the power cord and exposed outside the vacuum cleaner, and unwinds the power cord from the cord reel. The user then connects the plug with the commercial electric power source, that is, an electrical outlet in a cleaning area, to supply electric power to the vacuum cleaner.

When plugged into the electrical outlet, the power cord generally generates heat due to current flowing thereinside. If the vacuum cleaner has high electrical consumption, the power cord of the vacuum cleaner generates more heat. As the power cord is wound on the cord reel, the power cord cannot emit heat as effectively. Accordingly, after the vacuum cleaner has been used for a long time, the heat generated by the power cord may cause the temperature of the power cord to rise as the power cord is wound around the cord reel. If the temperature rises enough, the sheath of the power cord or the plastic cord reel may melt, causing the power cord to stick together or even short circuit.

In an effort to solve these problems, apparatuses for cooling a power cord wound around a cord reel have been developed. For example, Korea Patent No. 10-2003-0386254 and Korean Patent Publication No. 20-1997-016177 disclose conventional power cord cooling apparatuses. The conventional power cord cooling apparatus of Korea Patent No. 10-2003-0386254 relates to a cord room structure formed in the main body of a vacuum cleaner for receiving a power cord wound on a reel wherein outside air may enter the cord room via the hole for withdrawing the power cord and may exit the cord room via a cooling hole in a partition wall between the cord room and a dust collecting chamber. The conventional power cord cooling apparatus of Korean Patent Publication No. 20-1997-016177 relates to a cord room structure formed in the main body of a vacuum cleaner for receiving a power cord wound on a reel, wherein outside air may enter the cord room via the hole for withdrawing the power cord and may exit the cord room via an air path connecting the cord room to an air suction port.

These conventional power cord cooling apparatuses, however, are configured so that the outside air contacts and cools only the outermost power cord coils among the power cord coils wound around the cord reel. Heat generated from the power cord therefore cannot be effectively dissipated.

SUMMARY OF THE INVENTION

Accordingly, to solve at least the above problems and/or disadvantages and to provide at least the advantages described below, it is a non-limiting object of the present invention to provide a power cord cooling apparatus for a vacuum cleaner capable of enhancing a cooling efficiency thereof, the power cord cooling apparatus for a vacuum cleaner comprising a power cord cooling apparatus disposed in a cord reel chamber formed inside a main body of the vacuum cleaner to cool a power cord wound around a cord reel, wherein the power cord cooling apparatus allows outside air to enter the cord reel chamber, to contact the power cord wound around the cord reel, and to be discharged outside the cord reel chamber via a center space in the cord reel.

The power cord cooling apparatus may include an isolating wall to partition off a contaminants collecting chamber from the cord reel chamber, the isolating wall having a cooling hole configured to allow fluid communication between the contaminants collecting chamber and the cord reel chamber; at least one hole in the cord reel configured to allow fluid communication between the cord reel chamber and the center space of the cord reel; a cord reel supporting unit disposed at the center space of the cord reel to rotatably support the cord reel; and a duct member configured to allow fluid communication between the cord reel supporting unit and the cooling hole; wherein outside air entering the cord reel chamber enters the center space of the cord reel and is discharged to the contaminants collecting chamber via the cord reel supporting unit, the duct member, and the cooling hole.

The cord reel may include a cylindrical member having a plurality of holes configured to allow fluid communication between the cord reel chamber and the center space of the cord reel, and a pair of disk members extending from opposite ends of the cylindrical member configured to hold the power cord therebetween.

The cord reel supporting unit may include a cord reel supporting member having at least one air passing hole formed on an outer circumferential surface thereof and a cavity, the at least one passing hole being configured to allow fluid communication between the out circumferential surface and the cavity; and a fixing member connected with the cord reel supporting member and configured to allow the cord reel supporting member to be fixed to a first partition wall disposed at a side of the cord reel chamber.

The duct member may include a first flow guide member connected with the cord reel supporting unit and a second flow guide member to connect the first flow guide member with the cooling hole in fluid communication.

The power cord cooling apparatus may also include a second partition wall disposed at a predetermined distance from the first partition wall in the cord reel chamber and the second flow guide disposed between the first partition wall and the second partition wall.

BRIEF DESCRIPTION OF THE DRAWINGS

The above and other aspects and/or advantages of the invention will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION OF THE EXEMPLARY EMBODIMENTS

Figure 1:
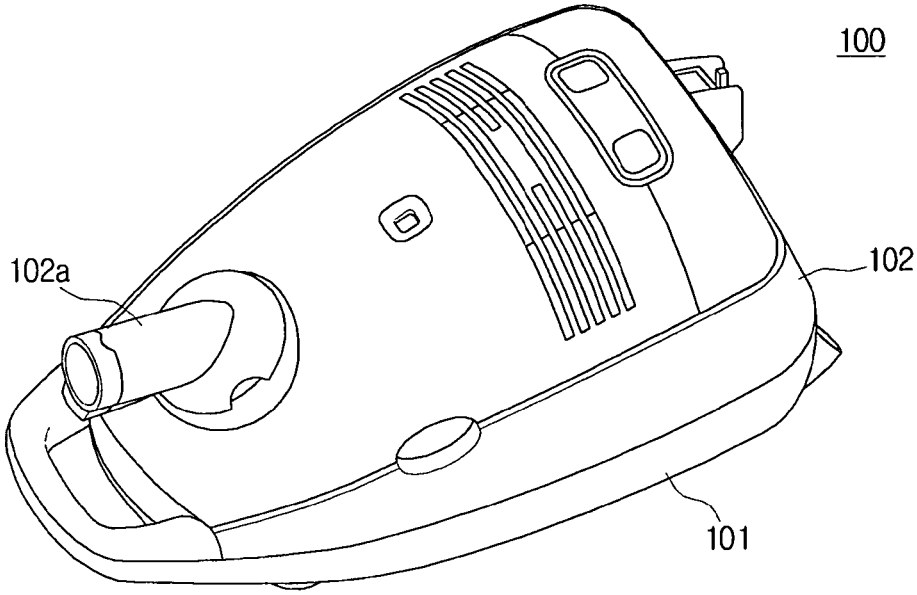
FIG. 1 is a perspective view illustrating a main body of a vacuum cleaner having a power cord cooling apparatus according to an exemplary embodiment of the present invention.

Reference will now be made in detail to the non-limiting embodiments of the present invention by way of reference to the drawings, wherein like reference numerals refer to like parts, components and structures.

Figure 2:
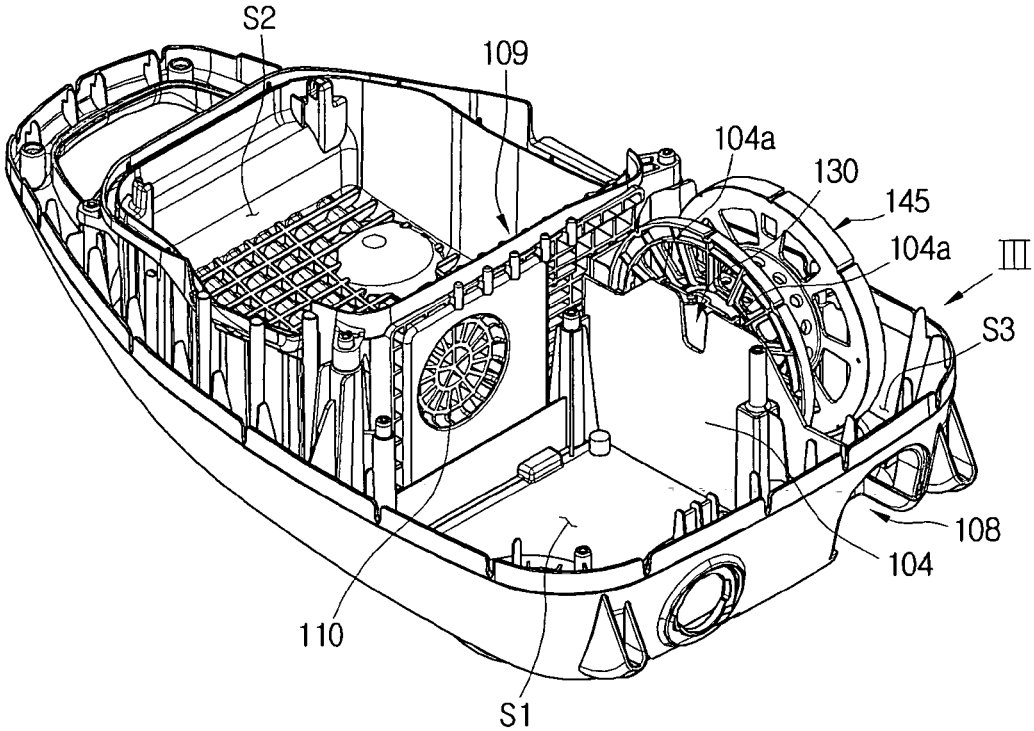
FIG. 2 is a perspective view illustrating a power cord cooling apparatus according to an exemplary embodiment of the present invention disposed in the main body of the vacuum cleaner of FIG. 1.

Referring to FIGS. 1 and 2, the main body 100 of the vacuum cleaner includes a bottom casing 101 and a top casing 102. The top casing 102 is provided with a flexible hose connector 102*a* to be connected with a flexible hose (not illustrated). The flexible hose allows a suction port assembly (not illustrated) to be fluidly communicated with a contaminants collecting chamber S2 so that contaminants laden air enters the contaminants collecting chamber S2 through the flexible hose. The bottom casing 101 is provided with an isolating wall 109 having a predetermined height. When the bottom casing 101 is coupled to the top casing 102, the contaminants collecting chamber S2 is formed in front of the isolating wall 109. Also, the bottom casing 101 is provided with a first partition wall 104 to connect the isolating wall 109 and a rear surface of the bottom casing 101 so that, when the bottom casing 101 is coupled to the top casing 102, a space behind the isolating wall 109 is partitioned into a suction motor chamber S1 and a cord reel chamber S3.

Figure 3:
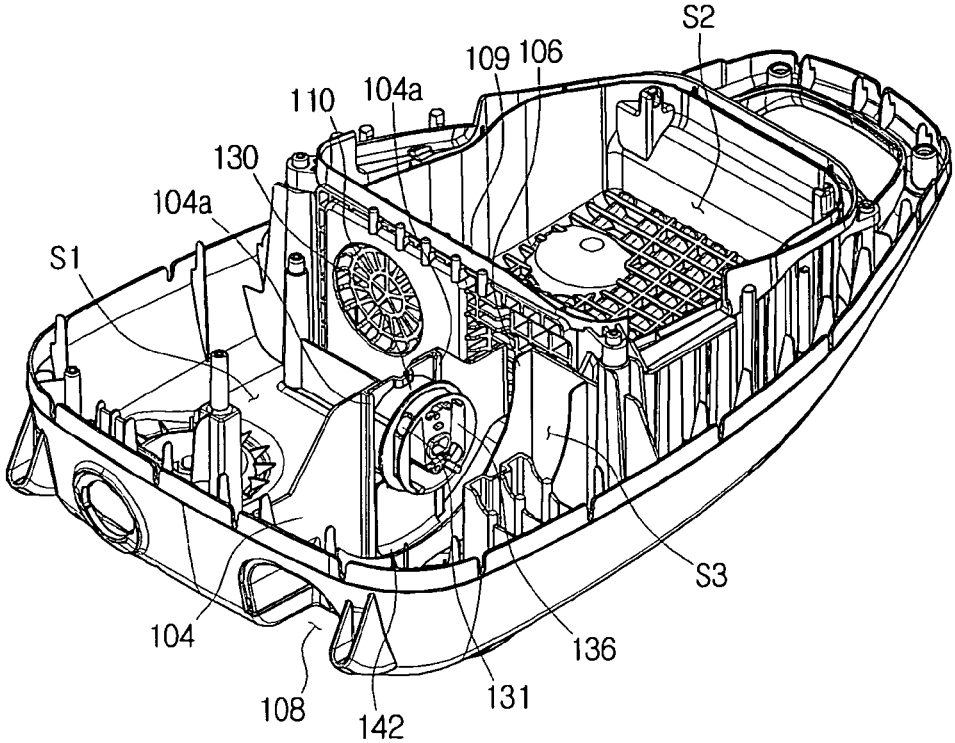
FIG. 3 is a perspective view illustrating the power cord cooling apparatus without a cord reel in a direction of arrow □ of FIG. 2.

Referring to FIGS. 2 and 3, a pair of guiding grooves 104*a* is vertically formed on the first partition wall 104 to be spaced apart from each other so that a cord reel supporting unit 130 and a duct member 140 can be inserted in the guiding grooves 104*a*. A second partition wall 106 has a top end formed in a curved line rising from the rear surface of the bottom casing 101 to the isolating wall 109 and is spaced a predetermined distance apart from the first partition wall 104. A cord hole 108 is formed at the rear surface of the bottom casing 101 to fluidly communicate the cord reel chamber S3 with outside of the main body 100 so that a power cord (not illustrated) wound on a cord reel 145 disposed in the cord reel chamber S3 can be withdraw from and put into the main body 100 of the vacuum cleaner.

Figure 4:
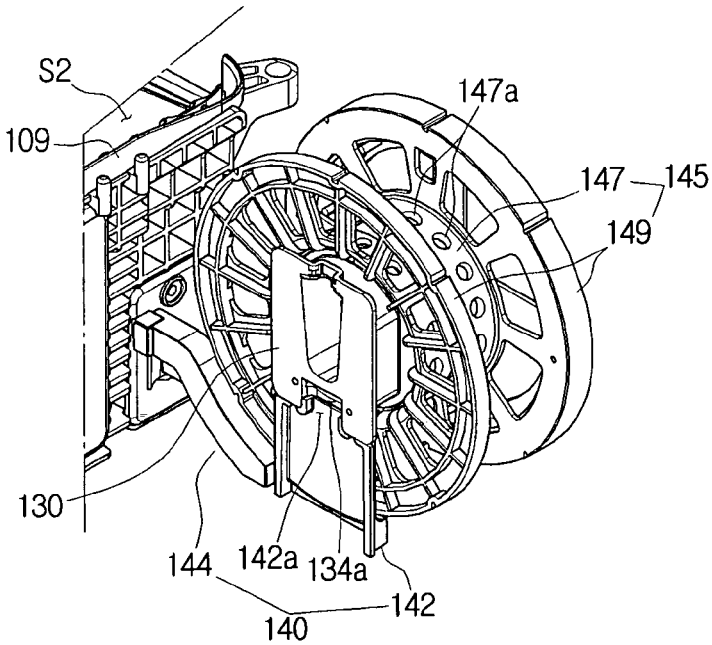
FIG. 4 is a perspective view illustrating a duct member, a cord reel supporting unit, and a cord reel of a power cord cooling apparatus according to an exemplary embodiment of the present invention.

According to the exemplary embodiment of the present invention illustrated in FIGS. 2 to 7, the power cord cooling apparatus for the vacuum cleaner includes the cord reel 145 with cooling holes 147*a*, the duct member 140, the cord reel supporting unit 130, and the isolating wall 109. The power cord (not illustrated) for supplying electric power to the vacuum cleaner is wound on the cord reel 145. Referring to FIGS. 2 to 4, the cord reel 145 is rotatably disposed at a cord reel supporting member 132 so that the power cord can come in and out the main body 100 of the vacuum cleaner through the cord hole 108. The cord reel 145 may include a cylindrical member 147 and a pair of disk members 149. The cylindrical member 147 has a center space formed substantially at the center thereof and the cord reel supporting member 132 is inserted in the center space. The cylindrical member 147 also includes plurality of cooling holes 147*a* (see FIG. 4) through which outside air may flow into the center space. A plurality of first air passing holes 131 are formed on the cord reel supporting member 132 so that when outside air enters the center space of the cord reel 145 via the plurality of cooling holes 147*a*, the entering outside air then enters a cavity 136 of the cord reel supporting member 132 via the first air passing holes 131. The pair of disk members 149 are disposed to extend from opposite ends of the cylindrical member 147 so that the power cord (not illustrated) is wound one upon another in coils around the cylindrical member 147 and between the disk members 149.

Figure 6:
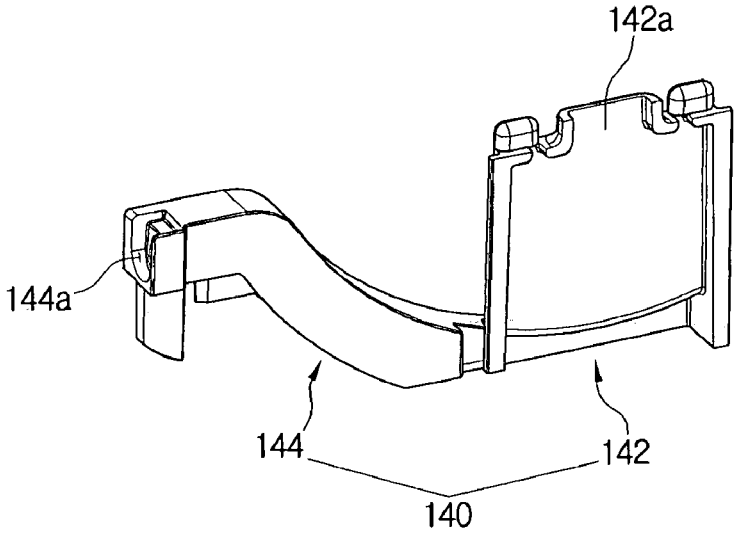
FIG. 6 is a perspective view illustrating the duct member of FIG. 4.
Figure 7:
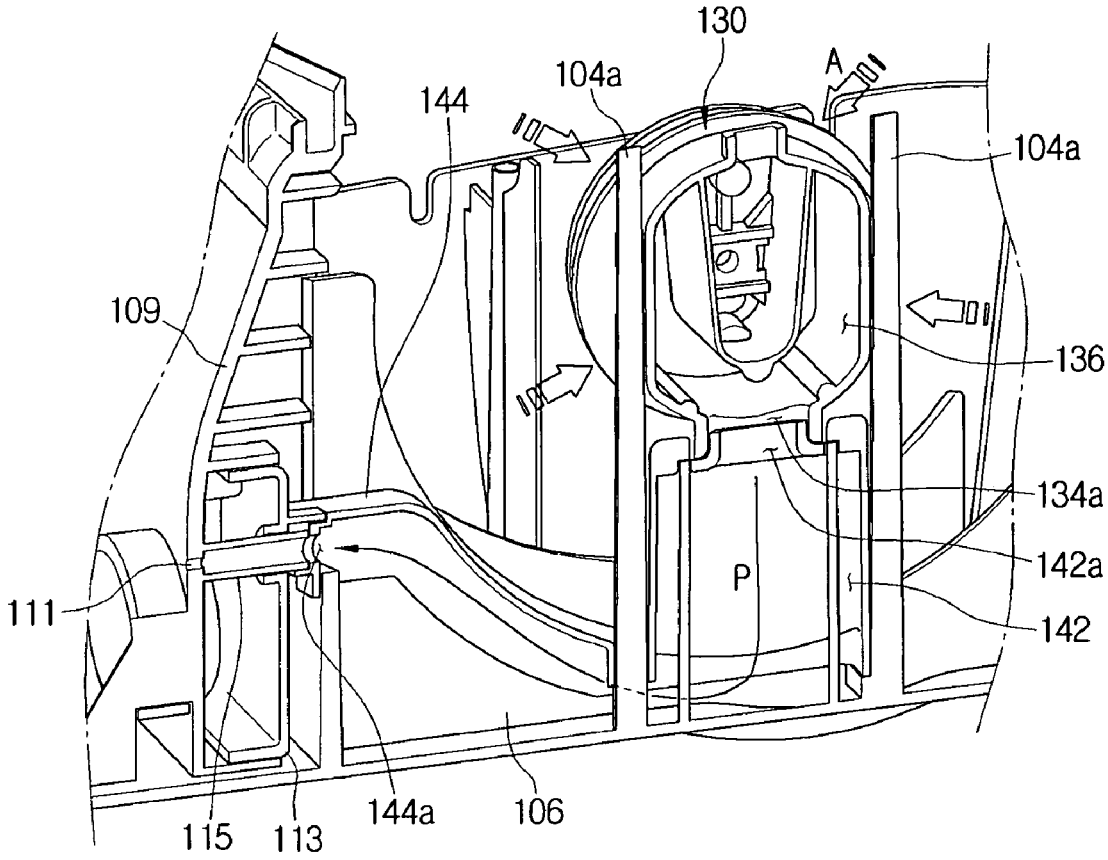
FIG. 7 is a partial sectional perspective view illustrating flowing of outside air in a power cord cooling apparatus according to an exemplary embodiment of the present invention.

According to the exemplary embodiment of the present invention illustrated in FIGS. 3, 4, and 6, the duct member 140 includes a first flow guide member 142 and a second flow guide member 144. The first flow guide member 142 is inserted in the pair of the guiding grooves 104*a* formed on the first partition wall 104 and has an inlet 142*a* formed at a top portion thereof through which the outside air enters the first flow guide member 142. The second flow guide member 144 is formed integrally in fluid communication with the first flow guide member 142 and has an outlet 144*a* formed at an end thereof as illustrated in FIG. 6. When the first flow guide member 142 is inserted in the guiding grooves 104*a*, the second flow guide member 144 is inserted between the first partition wall 104 and the second partition wall 106 so that the outlet 144*a* is fluidly communicated with the contaminants collecting chamber S2 via a cooling hole 111 and an air passage 115 formed in the isolating wall 109. The duct member 140 disposed between the first and second partition walls 104 and 106, as illustrated in FIG. 7, forms an air flowing path P to fluidly communicate with the contaminants collecting chamber S2 via the cooling hole 111 and air passage 115 in a lower portion of the bottom casing 101. In this exemplary embodiment, the duct member 140 is fluidly communicated with the cooling hole 111 via an air passage 115 formed to penetrate a damper cover 113. Alternatively, the duct member 140 may be directly connected with the cooling hole 111 without requiring an air passage 115 to penetrate a damper cover 113.

Figure 5:
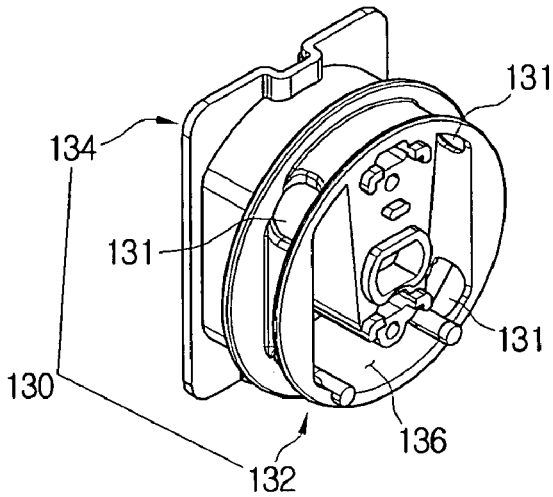
FIG. 5 is a perspective view illustrating the cord reel supporting unit of FIG. 4.

According to the exemplary embodiment of the present invention illustrated in FIGS. 4, 5 and 7, the cord reel supporting unit 130 is disposed substantially at the middle of the cord reel 145 to rotatably support the cord reel 145 while allowing the outside air entering the cord reel chamber S3 through the cord hole 108 to pass among the power cord coils (not illustrated) wound on the cord reel 145 before passing through the cooling holes 147*a* and moving into the air flowing path P formed by the duct member 140 via the cord real supporting unit 130.

The cord reel supporting unit 130 includes the cord reel supporting member 132 and a fixing member 134 formed integrally with the cord reel supporting member 132. The fixing member 134 is configured to be inserted in the guiding grooves 104*a* so that the supporting unit may be installed above the first flow guide member 142.

The cord reel supporting member 132 is formed substantially in a cylindrical shape and has four first air passing holes 131 formed on the outer circumferential surface thereof. The cavity 136 is formed substantially in a U shape inside the cord reel supporting member 132 and is configured so the cavity 136 fluidly communicates with the four first air passing holes 131 so that outside air can flow from the center space of the cord reel 145 into the cavity 136 via the four first air passing holes 131.

The fixing member 134 is formed integrally with the cord reel supporting member 132 in a rectangular shape. When the fixing member 134 is inserted in the guiding grooves 104*a*, the lower portion of the fixing member 134 and the first partition wall 104 form a second air passing hole 134*a* therebetween through which the outside air in the cavity 136 may be discharged from the cavity 136 (see FIG. 7). Accordingly, when the fixing member 134 is inserted in the guiding grooves 104*a*, the lower portion of the fixing member 134 mates with the top portion of the first flow guide member 142 so that the outside air discharged through the second air passing hole 134*a* enters the inlet 142*a* formed by the first flow guide member 142 and the first partition wall 104 (see FIG. 7).

Referring to FIG. 7, the cooling hole 111 is formed at the isolating wall 109 and the air passage 115 is extended from the isolating wall 109 around the cooling hole 111 to penetrate the damper cover 113. The damper cover 113 is disposed at a side of the isolating wall 109 to receive a damper apparatus (not illustrated) for adjusting the pressure of the contaminants collecting chamber S2. The cooling hole 111 and air passage 115 allow the cord reel chamber S3 to fluidly communicate with the contaminants collecting chamber S2.

An exemplary embodiment of the assembly and operation of the present invention is described hereinafter with reference to FIGS. 2 to 7.

The first flow guide member 142 of the duct member 140 is inserted in the pair of guiding grooves 104*a* formed on the first partition wall 104 so that the second flow guide member 144 formed integrally with the first flow guide member 142 is inserted between the first partition wall 104 and the second partition wall 106. In this configuration, the outlet 144*a* formed at the end of the second flow guide member 144 is in fluid communication with the cooling hole 111 and air passage 115 formed at the isolating wall 109. The fixing member 134 of the cord reel supporting unit 130 is inserted in the guiding grooves 104*a* so that the second air passing hole 134*a* formed at the lower portion of the cord reel supporting unit 130 is in fluid communication with the inlet 142*a* formed at the first flow guide member 142. Accordingly, when the cord reel supporting unit 130 and the duct member 140 are inserted in the guiding grooves 104*a* of the first partition wall 104, the air flowing path P is formed between the first partition wall 104, the second partition wall 106, the duct member 140, and the cord reel supporting unit 130.

When turning on a suction motor (not illustrated) disposed in the suction motor chamber S1, the contaminants collecting chamber S2 fluidly communicates with the suction motor via a motor suction hole 110, creating a vacuum state in the contaminants collecting chamber S2. When the contaminants collecting chamber S2 is in a vacuum state, a vacuum state is also created in the cord reel chamber S3 via the cooling hole 111, the air passage 115, the duct member 140, and the cord reel supporting unit 130. When the power cord (not illustrated) wound around the cord reel 145 generates heat due to current flowing therein, the vacuum state of the cord reel chamber S3 causes outside air to enter the cord reel chamber S3 through the cord hole 108 so that the outside air can cool the heat of the power cord. The outside air entering the cord reel chamber S3 cools the power cord by passing among the power cord coils wound around the cord reel 145 before moving through the plurality of cooling holes 147*a* formed on the cord reel 145. Accordingly, the outside air passes among the power cord coils wound around the cord reel 145 in a direction of arrows A illustrated in FIG. 7, thereby moving to the center space of the cord reel 145.

After passing through the plurality of cooling holes 147*a* of the cylindrical member 147 of the cord reel 145, the outside air passes through the four first air passing holes 131 formed on the cord reel supporting member 132 of the cord reel supporting unit 130 and then enters the U-shaped cavity 136. The outside air entering the cavity 136 flows into the inlet 142*a* of the duct member 140 via the second air passing hole 134*a* formed at the lower portion of the cord reel supporting unit 130. The outside air entering the inlet 142*a* moves along the air flowing path P formed by the duct member 140, the first partition wall 104, and the second partition wall 106. Then, in series, the outside air passes through the outlet 144*a* of the second flow guide member 144, the air passage 115, and the cooling hole 111 where it is discharged to the contaminants collecting chamber S2.

With the power cord cooling apparatus according to an exemplary embodiment of the present invention, the outside air passes among the power cord coils wound around the cord reel 145, passes through the cord reel supporting unit 130 and the duct member 140, and then enters the contaminants collecting chamber S2 so that a cooling efficiency is enhanced. Because the outside air passes among the power cord coils wound around the cord reel 145 and moves to the cord reel supporting unit 130 disposed in the center space of the cord reel 145, the outside air may flow past and contact all the power cord coils wound one upon another around the cord reel 145. As a result, the contact area between the outside air and the power cord is increased so that the cooling efficiency of the power cord is enhanced compared to conventional power cord cooling apparatuses that allow outside air to contact only the outmost power cord coils of the power cord coils wound one upon another.

In the exemplary embodiment of the present invention discussed above, when the outside air passes among the power cord coils wound one upon another around the cord reel and is discharged to the contaminants collecting chamber, the outside air can contact inward power cord coils of the power cord, thereby taking heat from the inward power cord coils so that the cooling efficiency of the power cord is enhanced.

While the embodiments of the present invention have been described with reference to certain embodiments thereof, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the invention.

What is claimed is:

1. A power cord cooling apparatus for a vacuum cleaner that is disposed in a cord reel chamber formed inside a main body of the vacuum cleaner to cool a power cord, the power cord cooling apparatus comprising:

at least one first cooling hole in fluid communication with a contaminants collecting chamber, the first cooling hole being disposed in an isolating wall that is configured to partition off the cord reel chamber from the contaminants collecting chamber;

a pair of guide grooves formed on a first partition wall, the first partition wall being configured to partition off the cord reel chamber from a suction motor chamber;

a cord reel disposed in the cord reel chamber having a hub portion around which the power cord is wound, the hub portion defining a center space and having at least one second cooling hole configured to allow fluid communication between the center space of the cord reel and the cord reel chamber;

a cord reel supporting unit disposed in the pair of guide grooves on the first partition wall and extending into the center space of the hub portion of the cord reel to rotatably support the cord reel on the first partition wall; and a duct member disposed adjacent to the cord reel supporting unit in the pair of guide grooves on the first partition wall, the duct member being configured to allow fluid communication between the at least one first cooling hole and the center space of the cord reel;

wherein outside air enters the cord reel chamber, contacts the power cord wound around the cord reel as it moves into the center space of the cord reel, and is discharged to the contaminants collecting chamber via the duct member and the at least one first cooling hole.

2. The power cord cooling apparatus of claim 1, wherein the hub portion is cylindrical and has a pair of disk members extending from opposite ends thereof that are configured to hold the power cord therebetween.

3. The power cord cooling apparatus of claim 1, wherein the cord reel supporting unit includes:

at least one air passing hole formed on an outer circumferential surface thereof and a cavity, the at least one passing hole being configured to allow fluid communication between the center space of the cord reel and the cavity; and a fixing member configured to be inserted into the pair of guide grooves on the first partition wall, wherein the duct member is in fluid communication with the center space of the cord reel via the cavity and outside air is discharged to the contaminants collecting chamber via the duct member, the cord reel supporting unit, and the at least one first cooling hole.

4. The power cord cooling apparatus of claim 1, wherein the duct member includes:

a first flow guide member connected with the cord reel supporting unit; and a second flow guide member to connect the first flow guide member with the cooling hole in fluid communication.

5. The power cord cooling apparatus of claim 4, wherein the power cord cooling apparatus includes a second partition wall disposed at a predetermined distance from the first partition wall in the cord reel chamber and the second flow guide is disposed between the first partition wall and the second partition wall.

6. The power cord cooling apparatus of claim 1, wherein outside air enters the cord reel chamber through a hole in the main body of the vacuum through which the power cord is withdrawn.

* * * * *